US005525448A

United States Patent [19]

Larson et al.

[11] Patent Number: 5,525,448

[45] Date of Patent: Jun. 11, 1996

[54] LIQUID DEVELOPER COMPOSITIONS WITH QUATERNIZED POLYAMINES

[75] Inventors: James R. Larson, Fairport; John W. Spiewak, Webster, both of N.Y.

[73] Assignee: Xerox Corporation, Stamford, Conn.

[21] Appl. No.: 220,860

[22] Filed: Mar. 31, 1994

[51] Int. Cl.[6] ..... G03G 9/13

[52] U.S. Cl. ..... 430/115; 430/119

[58] Field of Search ..... 430/114, 115, 430/119

[56] References Cited

U.S. PATENT DOCUMENTS

| | | | |
|---|---|---|---|
| 4,273,849 | 6/1981 | Merrill et al. | 430/119 |
| 4,681,831 | 7/1987 | Larson et al. | 430/114 |
| 4,707,429 | 11/1987 | Trout | 430/115 |
| 4,772,528 | 9/1988 | Larson et al. | 430/115 |
| 4,917,985 | 4/1990 | El-Sayed et al. | 430/114 |
| 5,066,821 | 11/1991 | Houle et al. | 430/137 |
| 5,308,730 | 5/1994 | Suzuki et al. | 430/115 |

*Primary Examiner*—John Goodrow
*Attorney, Agent, or Firm*—E. O. Palazzo

[57] ABSTRACT

A positively charged liquid developer comprised of thermoplastic resin particles, pigment, a charge director, and an insoluble charge adjuvant comprised of a polymeric quaternary ammonium compound, and wherein the charge adjuvant is associated with or combined with said resin and said pigment.

28 Claims, No Drawings

LIQUID DEVELOPER COMPOSITIONS WITH QUATERNIZED POLYAMINES

BACKGROUND OF THE INVENTION

This invention is generally directed to liquid developer compositions and, more specifically, the present invention relates to a liquid developer containing polymeric quaternary ammonium compounds, or quaternized polyamines as charge adjuvants. More specifically, the present invention relates to positively charged liquid developers comprised of a suitable carrier liquid and as a charge adjuvant certain quaternized polyammonium salts, such as poly(styrene-co-N,N,N-trimethylammonium-N- 2-ethyl methacrylate tosylate), poly(4-vinylpyridine-co-4-vinyl-N-methylpyridinium bromide), poly(2-hydroxyethyl methacrylate-co-N,N,N-trimethylammonium-N- 2-ethyl methacrylate chloride), poly(N,N-dimethyl- 3,5-dimethylenepiperidinium chloride) and the like. The developers of the present invention can be selected for a number of known imaging systems, such as xerographic imaging and printing processes, wherein latent images are rendered visible with the liquid developers illustrated herein. The image quality, solid area coverage and resolution for developed images usually require, for example, sufficient toner particle electrophoretic mobility. The mobility for effective image development is primarily dependent on the imaging system used, and this electrophoretic mobility is directly proportional to the charge on the toner particles and inversely proportional to the viscosity of the liquid developer fluid. For example, an about 10 to 30 percent change in fluid viscosity caused for instance by an about 5° to 15° C. decrease in temperature could result in a decrease in image quality, poor, or unacceptable image development, and undesirable background development, for example, because of a 5 percent to 23 percent decrease in electrophoretic mobility. Insufficient particle charge can also result in poor, or no transfer of the toner to paper or other substrates. Poor transfer, for example, can result in poor solid area coverage if insufficient toner is transferred to the final substrate and can also result in image defects such as smearing and hollowed fine features. To overcome or minimize such problems, the liquid toners of the present invention were arrived at after extensive research efforts, and which toners result in, for example, sufficient particle charge, generally corresponding to an ESA mobility of greater than 1.0 E-10 $m^2/Vs$ for excellent transfer, and maintaining this mobility within the desired range of the particular imaging system employed. Advantages associated with the present invention include improvements in the desired positive charge on the developer particles; in some instances the improvement, as measured by ESA mobility, is from +0.7 E-10 $m^2/Vs$ with out the quaternized polyamine charge control component to +1.2 E-10 $m^2/Vs$ when the quaternized polyamine compounds of the present invention are selected. The greater toner charge results in, for example, improved image development and higher quality images, such as higher resolutions with less background deposits.

A latent electrostatic image can be developed with toner particles dispersed in an insulating nonpolar liquid. Such dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

Since the formation of proper images depends primarily on the difference of the charge between the toner particles in the liquid developer and the latent electrostatic image to be developed, it is desirable to add a charge director compound and optional charge adjuvants which increase the magnitude of the charge, such directors being, for example, polyhydroxy compounds, amino alcohols, polybutylene succinimide compounds, aromatic hydrocarbons, metallic soaps, and the like, to the liquid developer comprising the thermoplastic resin, the nonpolar liquid and the colorant.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, illustrates a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) selected from the group consisting of vinyl toluene and styrene, and (iv) selected from the group consisting of butadiene and acrylate. A copolymer of polyethylene and methacrylic acid or methacrylic acid alkyl esters, NUCREL®, may also be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. These liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin of a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of the: block copolymer is oriented to the surface thereof, and the compatible segment thereof is oriented to be compatible with other resins and a coloring agent contained in the toner, thereby providing the toner with both liquid-repelling and solvent-soluble properties.

In U.S. Pat. No. 4,707,429, there are illustrated, for example, liquid developers with an aluminum stearate charge adjuvant. Liquid developers with certain charge directors are illustrated in U.S. Pat. No. 5,045,425. Also, stain elimination in consecutive colored liquid toners is illustrated in U.S. Pat. No. 5,069,995.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer possesses a melting point of at least about 25° C., and wherein the contact occurs while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,306,591 and U.S. Pat. No. 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively. In U.S. Statutory Invention Registration No. H1,483, the disclosure of which is totally incorporated herein by reference, there is illustrated a liquid developer comprised of thermoplastic resin particles, and a charge director comprised of-an ammonium AB diblock copolymer of the formula

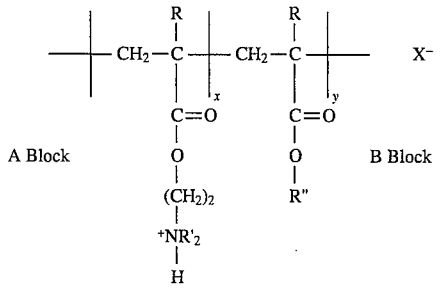

wherein X- is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 100 to 20.

SUMMARY OF THE INVENTION

It is an object of the present invention to provide a liquid developer with many of the advantages illustrated herein.

Another object of the present invention resides in the provision of a liquid developer capable of high particle charging.

It is a further object of the invention to provide positively charged liquid developers wherein there are selected as insoluble charge adjuvants, or charge additives quaternary polyammonium salts.

It is still a further object of the invention to provide a liquid developer wherein developed image defects, such as smearing, loss of resolution and loss of density, are eliminated, or minimized, and wherein there are selected economical charge components that permit toners that can be easily transferred from imaging members such as photoreceptor drums.

Also, in another object of the present invention there are provided positively charged liquid developers with certain charge adjuvants.

Another object of the present invention resides in the provision of liquid developers with known additives and certain quaternary ammonium polymer adjuvants; and wherein the resulting liquid developers minimize the charging tendencies of the pigments selected, and wherein these adjuvants are not leached into the hydrocarbon liquid or charge director.

These and other objects of the present invention can be accomplished in embodiments by the provision of liquid developers with certain charge adjuvants comprised of quaternary polyammonium compounds. In embodiments, the present invention is directed to positively charged liquid developers comprised of a toner resin, pigment, and a charge adjuvant comprised of certain quaternary polyammonium compounds wherein the quaternary polyammonium compound is comprised of from about 0.1 to about 20 weight percent and preferably from about 1 to about 10 weight percent of the toner composition, and wherein the ammonium repeat unit composition in the quaternary polyammonium polymers is from about 5 to about 100 weight percent and preferably from about 20 to about 100 weight percent. The quaternary polyammonium polymer may be random, blocked or segmented.

Two general Formulas I and II that follow can be utilized to illustrate the quaternary polyammonium charge adjuvant compounds of the present invention, wherein R is an aliphatic group like alkyl, and X is an anion like a halide, tosylate, and the like. In the polyammonium compounds I, a polymer backbone is substituted with pendent groups which generally contain a spacer or group of atoms separating the ammonium group in the pendent group from the polymer backbone. The spacer may be absent, thus the ammonium group is attached directly to the polymer backbone and comprises the entire pendent group. The pendent ammonium group may be incorporated in an aromatic or nonaromatic ring structure or may be acyclic. In the polyammonium compounds of II, the polymer backbone contains the ammonium group therein. The backbone ammonium group may be incorporated in a cyclic ring structure or may be acyclic. Also, polyammonium compounds, which contain both pendent and backbone ammonium groups, can be selected in embodiments. The pendent group may contain in the group of atoms comprising the spacer various chemically inert functional group such as an ester, amide, ether and the like that remain unreactive during the toner preparation processes. The polymer backbone can generally be hydrocarbon and may also contain heteroatoms or heteroatom groups.

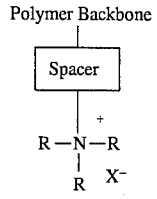

I

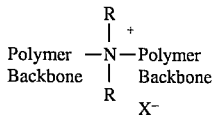

II

In embodiments, the present invention is directed to positively charged liquid developers comprised of a toner resin, pigment, and a charge adjuvant comprised of certain quaternary polyammonium compounds including preferably poly(styrene-co-N,N,N-trimethylammonium-N- 2-ethyl methacrylate tosylate), poly(4-vinylpyridine-co- 4-vinyl-N-methylpyridinium bromide), poly(2-hydroxyethyl methacrylate-co-N,N,N-trimethylammonium-N-2-ethyl methacrylate chloride), poly(N,N-dimethyl-3,5-dimethylenepiperidinium chloride), and the like dispersed in a mixture of a liquid and a charge director. The polyammonium charge adjuvant compounds can be prepared by polymerization of amine containing monomers alone or with suitable nonamine containing comonomers. The amine monomers include 2-dimethylaminoethyl methacrylate, 2-dimethylaminoethyl acrylate, 2-t-butylaminoethyl methacrylate, 4-vinylpyridine, 2-vinyl pyridine, 3-dimethylaminopropyl methacrylamide, 4-vinyl-N,N-dimethylaniline, 4-vinyl-N,N-dimethylamino-alpha toluene, diallylamine, N-methyldiallylamine, ethylenimine, propylenimine, N-substituted ethylene and propylene imines, vinylamines and substituted vinylamines, and the like. Suitable nonamine containing comonomers include vinyl aromatic monomers such as styrene and substituted styrenes including p-tert butylstyrene, p-methylstyrene, p-chlorostyrene, alpha methylstyrene, vinylnaphthalene and the like; alpha olefins including ethylene, propylene, butylene, isobutylene, decene and the like; conjugated dienes such as butadiene, isoprene, chloroprene, and the like; hydroxy containing acrylic and methacrylic monomers including 2-hydroxyethyl methacrylate, 2-hydroxyethyl acrylate, 2-hydroxypropyl acrylate, 2-hydroxypropyl methacrylate, tetrahydrofurfuryl methacrylate, tetrahydrofurfuryl acrylate, methyl methacrylate, cyclohexyl methacrylate, t-butyl methacrylate, lauryl methacrylate, lauryl acrylate, stearyl methacrylate, stearyl acrylate, 2-phenoxyethyl methacrylate, 2-phenoxyethyl acrylate, 2-ethylhexylmethacrylate, 2-ethylhexylacrylate, methacrylic acid, acrylic acid and the like; substituted and nonsubstituted acrylamides and methacylamides including N-hydroxypropyl methacrylamide, N-methylacrylamide, N,N-dimethylmethacrylamide and the like; and acrylonitrile and methacrylonitrile and any other suitable vinyl monomers such as vinyl acetate, N-vinyl-2-pyrrolidone, vinyl caprolactam, vinyl chloride, and vinylidene chloride. Suitable quaternizing agents used to quaternize the poly amine compound after it has been polymerized or copolymerized, or prior to polymerization of the amine monomer, include alkyl halides such as methyl and ethyl iodide; methyl bromide, ethyl bromide, butyl bromide, allyl bromide, and benzyl bromide; methyl chloride and ethyl chloride; lower alkyl sulfonates including methyl p-tolene sulfonate, methyl p-bromobenzene sulfonate, methyl p-nitrobenzene sulfonate, methyl sulfonate, methyl trifluoromethane sulfonate, and the like; alkyl sulfates such as methyl sulfate and ethyl sulfate; and functionalized alkyl bromides such as methyl bromoacetate, bromoacetic acid, 4-bromobutyric acid, 2-bromoethanol, 1,2-dihydroxy-3-bromopropane, 2-bromoethyl ethyl ether, iodoacetonitrile, iodoacetamide, and 3-trimethylammonium bromide-1-bromopropane.

Embodiments of the present invention include a liquid developer comprised of thermoplastic resin particles, and a charge adjuvant comprised of certain quaternary polyammonium compounds as illustrated herein; a liquid developer comprised of a liquid component, thermoplastic resin, and pigment; a charge adjuvant comprised of certain quaternary polyammonium compounds, a charge director compound as illustrated herein; and wherein the charge adjuvant, resin and pigment are dispersed in the liquid component charge director mixture; and a positively charged liquid electrostatographic developer comprised of (A) a liquid having viscosity of from about 0.5 to about 20 centipoise and resistivity greater than $5\times10^9$; (B) thermoplastic resin particles with an average volume particle diameter of from about 0.1 to about 30 microns, and optional pigment; (C) a charge adjuvant comprised of certain quaternary polyammonium compounds as illustrated herein, and wherein the charge adjuvant is associated with or combined, preferably permanently, with the resin and optional pigment; and (D) a charge director compound.

In embodiments, the present invention relates to a liquid developer comprised of thermoplastic resin particles, and a charge adjuvant comprised of certain polymeric quaternary ammonium compounds as illustrated herein, and wherein the charge adjuvant is associated with or combined with the resin particles.

A positively charged liquid developer of the present invention possesses a charge sufficient to result in a particle mobility greater than about $1.30\times10^{-10}$ $m^2/Vs$ and preferably greater than $1.50\times10^{-10}$ $m^2/Vs$, and in embodiments from about 1.30 to about 2, and preferably about 1.80 as measured with the Matec ESA apparatus; and which developer is comprised of a liquid component, thermoplastic resin, optional pigment, a charge adjuvant comprised of an ammonium polymer or copolymer such as poly(styrene-co-4-vinyl-N-methylpyridinium chloride), poly(styrene-co-4-vinyl-N-methylpyridinium bromide), poly(styrene-co-4-vinyl-N-methyl pyridinium tosylate), poly(2-ethylhexyl methacrylate-co-N,N,N-trimethylammonium-N- 2-ethyl methacrylate bromide), poly(2-ethylhexyl methacrylate-co-N,N,N-trimethylammonium-N-2-ethyl methacrylate nitrate), poly(2-ethylhexyl methacrylate-co-N,N,N-triethylammonium-N-2-ethyl methacrylate chloride), poly(n-butylmethacrylate-co-N,N,N-triethylammonium-N- 2-ethyl methacrylate chloride), poly(styrene-co-N,N,N-trimethylammonium-N- 2-ethyl methacrylate tosylate), poly(4-vinyl-N-methylpyridinium bromide), poly(4-vinyl-N-methylpyridinium chloride), poly(4-vinyl-N-methyl pyridinium tosylate), poly(2-hydroxyethyl methacrylate-co-N,N,N-trimethylammonium-N-2-ethyl methacrylate chloride), poly(2-hydroxyethyl methacrylate-co-4-vinyl-N-methylpyridinium chloride), poly(2-hydroxyethyl methacrylate-co-4-vinyl-N-methylpyridinium bromide), poly(2-hydroxyethyl methacrylate-co-4-vinyl-N-methylpyridinium tosylate), poly(N,N-dimethyl-3,5-dimethylenepiperidinium chloride) and the like, which adjuvant is present in various effective amounts such as, for example, from about 0.1 to about 10 weight percent of the liquid toner solids which include resin, optional pigment and charge adjuvant, and a charge director; and a positively charged liquid electrostatographic developer comprised of (A) a liquid having viscosity of from about 0.5 to about 20 centipoise and resistivity greater than $5\times10^9$; (B) thermoplastic resin particles with an average volume particle diameter of from about 0.1 to about 30 microns and pigment particles; (C) a charge adjuvant comprised of certain polymeric quaternary ammonium compounds as illustrated herein; and (D) a charge director.

In embodiments, it is important that the toner particles be comprised of the thermoplastic resin, the charge adjuvant, and pigment. Therefore, it is important that the thermoplastic resin and the charge adjuvant be sufficiently compatible that they do not form separate particles and that the charge adjuvant be substantially insoluble in the hydrocarbon selected to the extent that not more than about 0.1 weight percent be soluble in the nonpolar liquid in embodiments.

The charge director can be selected for the liquid developers in various effective amounts such as, for example, in embodiments from about 5 to 1,000 milligrams of charge director per gram of toner solids and preferably 10 to 100 milligrams/gram. Developer solids include toner resin, pigment, and charge adjuvant. Without pigment, the developer may be selected for the generation of a resist, a printing plate, and the like.

Examples of effective charge directors for positive liquid toner particles include anionic glyceride, such as EMPHOS® D70-30C and EMPHOS® F27-85, two products available from Witco Corporation, New York, N.Y., which are sodium salts of phosphated mono- and diglycerides with saturated and unsaturated substituents, respectively, lecithin, Neutral Barium Petronate, Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, and zinc resinates; hydroxy bis[3,5-tertiary butyl salicyclic]aluminate monohydrate, and the like. Other effective positive charge directors include AB diblock copolymers of 2-ethylhexylmethacrylate-co-methacrylic acid calcium and ammonium salts as illustrated in U.S. Pat. No. 5, 130,221, the disclosure of which is totally incorporated herein by reference.

Examples of liquid carriers, or nonpolar liquids selected for the developers of the present invention include a liquid with an effective viscosity as measured, for example, by a number of known methods such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon as illustrated herein. A nonpolar liquid of the ISOPAR® series, available from Exxon Corporation, may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR® M has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr. in embodiments. The amount of liquid carrier or nonpolar liquid is 75 to 99.9 weight percent and preferably between 95 and 99 weight percent.

In embodiments, the ISOPAR® series liquids are the preferred nonpolar liquids for use as dispersants in the liquid developers of the present invention; the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 75 percent to about 99.9 percent, and preferably from about 95 to about 99 percent by weight of the total developer dispersion. The total solid components content of the developer is, for example, from about 0.1 to 25 percent by weight, and preferably 1.0 to 5 percent by weight.

Typical suitable thermoplastic toner resins can be selected for the liquid developers of the present invention in effective amounts of, for example, in the range of about 99 percent to about 40 percent, and preferably about 95 percent to about 70 percent of developer solids, comprised of thermoplastic resin, pigment, charge adjuvant, and in embodiments other optional components such as magnetic materials, like magnetites that may comprise the developer. Generally, developer solids include the thermoplastic resin, pigment and charge adjuvant. Examples of thermoplastic resins include ethylene vinyl acetate (EVA) copolymers, (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid (optional but preferred), and at least one alkyl ester of acrylic or methacrylic acid wherein alkyl is 1 to 20 carbon atoms, such as methyl methacrylate (50 to 90 percent)/methacrylic acid (1:) to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an α,β-ethylenically unsaturated acid of either acrylic acid or methacrylic acid. In a preferred embodiment, NUCREL® resins available from E. I. DuPont de Nemours and Company like NUCREL 599®, NUCREL 699®, or NUCREL 960® are selected as the thermoplastic resin.

The liquid developer of the present invention preferably contains a colorant and charge adjuvant dispersed in the resin particles. Colorants, such as pigments or dyes like black, cyan, magenta, yellow, red, blue, green, brown, and mixtures thereof wherein any one colorant may comprise from 0.1 to 99.9 weight percent of the colorant mixture with a second, or other additional colorants comprising the remaining percentage thereof.

The colorant may be present in an effective amount of, for example, from about 0.1 to about 60 percent, and preferably from about 10 to about 30 percent by weight based on the total weight of solids contained in the developer. The amount of colorant used may vary depending on the use of the developer, for example when the toned image is selected for the formation of a chemical resist image no colorant like pigment is necessary. Examples of pigments which may be selected include carbon blacks available from, for example, Cabot Corporation (Boston, Mass.), such as MONARCH 1300®, REGAL 330® and BLACK PEARLS®, and color pigments like FANAL PINK™, PV FAST BLUE™, and Paliotol Yellow D1155; pigments as illustrated in U.S. Pat. No. 5,223,368 (D/90404), the disclosure of which is totally incorporated herein by reference; and the following.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field and the measurement of sound described in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. No. 5,066,821, U.S. Pat. No. 5,034,299,

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

and U.S. Pat. No. 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, certain charge adjuvants can be added to the toner particles, examples of which include poly(styrene-co-4-vinyl-N-methylpyridinium chloride), poly(styrene-co-4 -vinyl-N-methylpyridinium bromide), poly(styrene-co-4-vinyl-N-methylpyridinium tosylate), poly(2-ethylhexyl methacrylate-co-N,N,N-trimethylammonium-N- 2-ethyl methacrylate bromide), poly(2-ethylhexyl methacrylate-co-N,N,N-trimethylammonium-N-2-ethyl methacrylate nitrate), poly(2-ethylhexyl methacrylate-co-N,N,N-triethylammonium-N-2-ethyl methacrylate chloride), poly(n-butylmethacrylate-co-N,N,N-triethylammonium-N- 2-ethyl methacrylate chloride), poly(styrene-co-N,N,N-trimethylammonium-N- 2-ethyl methacrylate tosylate), poly(4-vinyl-N-methylpyridinium bromide), poly(4-vinyl-N-methylpyridinium chloride), poly(4-vinyl-N-methylpyridinium tosylate), poly(2-hydroxyethyl methacrylate-co-N,N,N-trimethylammonium-N-2-ethyl methacrylate chloride), poly(2-hydroxyethyl methacrylate-co-4-vinyl-N-methylpyridinium chloride), poly(2-hydroxyethyl methacrylate-co-4-vinyl-N-methylpyridinium bromide), poly(2-hydroxyethyl methacrylate-co-4-vinyl-N-methylpyridinium tosylate), poly(N,N-dimethyl-3,5-dimethylenepiperidinium chloride) and the like. The adjuvants can be added to the liquid toner particles in an amount of from about 0.1 percent to about 20 percent of the total developer solids of toner resin, pigment, and charge adjuvant, and preferably from about 1 percent to about 10 percent of the total weight of solids contained in the developer.

The liquid electrostatic developer of the present invention can be prepared by a variety of known processes, such as, for example, mixing, in a nonpolar liquid with the thermoplastic resin, charge adjuvant, and colorant like pigment in a manner that the resulting mixture contains about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding a charge director compound to the dispersion; and diluting the dispersion to 1 percent to 2 percent solids; and wherein the resin, pigment and charge adjuvant are dispersed in the liquid and charge director mixture.

In the initial mixture, the resin, colorant and charge adjuvant may be added separately to an appropriate vessel which can vary in size from 50 milliliters to 1,000 liters such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 centrifugal automatic particle analyzer manufactured by Horiba Instruments, Inc., Irvine, Calif.

Image quality of the developers of the invention was determined on a Savin 870 copier modified as follows.

1) disconnecting the image density feedback loop from the development electrode and connecting the electrode to a Trek Model 610 high voltage power supply (Trek, Medina, N.Y.), 2) disconnecting the transfer corona and connecting same to a Trek Model 610 high voltage power supply (Trek, Medina, N.Y.).

To evaluate positive developers, this system was operated with a reverse image target with white characters on a black background such that the image had a positive voltage less than the development voltage and the background had a positive voltage greater than the image voltage thus resulting in the positive particles being pushed selectively onto the image area. Development voltage ranged form 500 to 1,000 volts. Transfer to paper was conducted at −6,500 volts.

CHARGE ADJUVANT SYNTHESIS 1

Poly(styrene-co-N,N-dimethylamino-N-2-ethyl methacrylate)—1A—Precursor to 1B and 1C A 2 liter four neck round bottom flask, equipped with a thermometer, mechanical stirrer, and an Argon inlet and outlet on top of a water condenser to a gas bubbler was charged with 900 grams of toluene, 195 grams of 2-dimethylaminoethyl methacryate (Scientific Polymer Products, Inc. No. M-167) and 105 grams of styrene (Aldrich No. $497-2). The methacrylate monomer was first passed through a DHR-4 column (Scientific Polymer Products, Inc.) to remove the methyl hydroquinone inhibitor. The styrene was used as received. The monomer solution was charged with 1.05 gram of AIBN initiator and was sparged with Argon at ambient temperature for 1 hour before heating was begun. The solution was mechanically stirred under a gentle Argon flow while heating in an oil bath. A solution temperature of 68° to 70° C. was maintained for 46 hours after which heating was terminated and the solution cooled to ambient temperature while still under a gentle Argon flow. The poly(styrene-co-2-dimethylaminoethyl methacrylate) product was isolated by coagulating 250 milliliter portions of the copolymer solution into 2.5 liter portions of hexane (5x) with mechanical stirring. The coagulated copolymer was allowed to air dry overnight for about 17 hours at ambient temperature in the fume hood and was finally dried in vacuo (about 0.3 millimeter Hg) for about 17 hours at 50° to 55° C. to provide 181.2 grams of the product of poly-(styrene-co-N,N-dimethylamino-N-2-ethyl methacrylate)—1A. $^1$H-NMR analysis in $CDCl_3$ indicated about 54 mole percent 2-dimethylaminoethyl methacrylate and 46 mole percent styrene repeat units.

Poly(styrene-co-N,N,N-trimethylammonium-N-2-ethyl methacrylate tosylate)-1B

A 2 liter 3 neck round bottom flask equipped with a thermometer, a water condenser, and a mechanical stirrer was charged with 70 grams of poly(styrene-co-N,N-dimethylamino-N-2-ethyl methacrylate)—1A pre-quaternized copolymer, and 47.60 grams (0,256 mole) of methyl tosylate (Aldrich No. 15,899-2) and 620.4 grams of toluene. The pre-quaternized copolymer contains 44.66 grams (0.284 mole) of 2-dimethylaminoethyl methacrylate repeat units for a charged quaternization level of 90 mole percent. The initial solution rapidly yielded a precipitate upon gentle warming. The mixture was stirred for 48 hours at about 50° C. (oil bath) and was then vacuum filtered on a coarse frit funnel. The solid was washed on the funnel with 200 milliliters of toluene and was sucked down and dried overnight for about 17 hours in vacuo at 55° to 60° C. at 0.3 millimeter Hg to provide 116.8 grams (99 percent) of the product poly(styrene-co-N,N,N-trimethylammonium-N-2-ethyl-methacrylate tosylate)—1B. $^1$H-NMR analysis in DMSO-$d_6$ and $D_2O$, respectively, indicated about 53 and 54 mole percent quaternized repeat units and 47 and 46 mole percent styrene repeat units.

Poly(styrene-co-N,N,N-trimethylammonium-N-2-ethyl methacrylate bromide)—1C

A 1 liter 3 neck round bottom flask equipped with a thermometer, a water condenser, and a mechanical stirrer was charged with 35 grams of poly(styrene-co-N,N-dimethylamino-N-2-ethyl methacrylate)—1A pre-quaternized copolymer, and about 400 grams of toluene solvent, and 71 milliliters (0.142 mole; 13.48 grams) of a 2 molar solution of methyl bromide in a methyl tertiary butyl ether solvent (Aldrich No. 33,828-1). The pre-quaternized copolymer contains 22.33 grams (0.142 mole) of 2-dimethylaminoethyl methacrylate repeat units for a charged quaternization level of 100 mole percent. The initial solution rapidly yielded a precipitate while stirring at ambient temperature. The mixture was stirred for 20 hours at ambient temperature and then was filtered on a coarse frit funnel to provide a solid paste still saturated with toluene. The paste was transferred to a medium frit funnel and was covered with acetone and was then vacuum filtered which helped to remove the bulk of the entrapped toluene. The solid was dried in vacuo (about 0.3 millimeters Hg) for 18.5 hours at about 55° C. and was pulverized and then dried further for 21 hours at 70° C. and finally for 17 hours at 107° C. $^1$H-NMR analysis in DMSO-$d_6$ indicated at least 88 mole percent of the originally present 2-dimethylaminoethyl methacrylate repeat units were quaternized to provide the product poly(styrene-co-N,N,N-trimethylammonium-N-2-ethyl methacrylate bromide)—1C.

Poly(styrene-co-N,N-dimethylamino-N-2-ethyl methacrylate)—1D; Precursor to 1E The polymerization procedure, scale and apparatus of charge adjuvant synthesis 1A was again employed except that 134.5 grams of 2-dimethylaminoethyl methacrylate and 165.5 grams of styrene were charged into the 900 grams of toluene solvent. After sparging with Argon, 1.20 grams (0.40 percent based on total monomer charge) of AIBN initiator was added and the polymerization solution was heated for 19 hours between 66 and 80° C. The polymer was coagulated and dried as described in charge adjuvant synthesis 1A, and 147.0 grams of product poly(styrene-co-N,N-dimethylamino-N- 2-ethyl methacrylate)—1D was isolated. $^1$H-NMR analysis in $CDCl_3$ indicated about 43 mole percent of 2-dimethylaminoethyl methacrylate and 57 mole percent of styrene repeat units.

Poly[styrene-co-N-(2-ethoxyethyl)-N,N-dimethylammonium-N-2-ethyl methacrylate bromide)—1E To a 100 milliliter single neck round bottom flask were added 10.0 grams of poly(styrene-co-N,N-dimethylamino-N-2-ethyl methacrylate)—1D and 47.1 grams of toluene. The 10 grams of 1D contain 5.27 grams (0.0335 mole) of 2-dimethylaminoethyl methacrylate repeat units to which were added 5.70 grams of 2-bromoethyl ethyl ether (Aldrich B6,620-5). Since the 2-bromoethyl ethyl ether is about 90 weight percent bromoether and 10 weight percent ethyl bromide, the 5.70 grams represent a 100 mole percent charge of the bromoether versus the 2-dimethylaminoethyl methacrylate repeat units in the 10 gram charge of 1D. The resulting solution was refluxed for 5 hours yielding a solid. The reaction mixture was cooled to ambient temperature and the solid product failed to dissolve upon adding 30 milliliters more toluene. The solid was vacuum filtered on a medium frit funnel and was dried for 16 hours in vacuo (about 0.3 millimeter Hg) at 50° to 55° C. to provide 12 grams of poly[styrene-co-N-(2 -ethoxyethyl)-N,N-dimethyl ammonium-N-2-ethyl methacrylate bromide)—1E. $^1$H-NMR analysis in $CDCl_3$ indicated about 58 mole percent of styrene and 42 mole percent of 2-dimethylaminoethyl methacrylate repeat units.

CHARGE ADJUVANT SYNTHESIS 2

Poly(4-vinylpyridine-co-4-vinyl-N-methylpyridinium bromide)

A 500 milliliter 3 neck round bottom flask equipped with a thermometer, a water condenser, and a magnetic stirring football was charged with 15 grams of Reillene 4200 powder, 170 grams of chloroform, and 91 grams of methanol to provide a yellow polymer solution. Reillene 4200 [poly(4-vinylpyridine)] is available from the Reilly Tar and Chemical Company and has a weight average molecular weight of 200,000. To this solution at ambient temperature was added a 2 molar solution of methyl bromide (53.5 ml) in t-butyl methyl ether (Aldrich No. 33,828-1). The 15 grams of poly(4-vinylpyridine) contains 0.143 mole of 4-vinylpyridine repeat units and the 53.5 milliliters contains 0.107 mole of methyl bromide for a charged 75 mole percent quaternization level. After overnight reflux, one-half of the copolymer solution by weight was rotoevaporated (50° to 60° C. at about 50 millimeters Hg for 1 to 2 hours) to dryness and $^1$H-NMR analysis ($D_2O$) indicated only about 60 mole percent quaternization. To the other half of the above solution was added an additional 7.1 milliliters of the 2M methyl bromide solution and the solution was refluxed (56° C.) for an additional 71 hours after which time a mixture resulted. The solvents were rotoevaporated (50° to 60° C. at about 50 millimeters Hg for 1 to 2 hours) from the mixture and the residual solid was dried in vacuo (0.3 millimeter Hg) at 50° to 60° C. for about 4 hours to provide 13.96 grams of the copolymer product poly(4-vinylpyridine-co-4-vinyl-N-methylpyridinium bromide). $^1$H-NMR analysis in $D_2O$ indicated about 80 mole percent of methyl bromide quaternized repeat units.

CHARGE ADJUVANT SYNTHESIS 3

Poly(2-hydroxyethyl methacrylate-co-N,N,N-trimethylammonium-N-2-ethyl methacrylate chloride)

A 500 milliliter four neck round bottom flask equipped with a thermometer, a magnetic stirring football, and an Argon inlet and outlet on top of a water condenser to a gas bubbler was charged with 20.77 grams (0.10 mole) of 2-trimethylammoniumethyl methacrylate chloride (Rohm Tech. Inc. Pleximon 735/Mhoromer BM-604-400 ppm MeHQ) in an equal weight of methanol, 13.01 grams (0.10 mole) of 2-hydroxyethyl methacrylate (Scientific Polymer Products M-124-600 ppm MeHQ) and 190 grams of methanol. Both monomers, the 2-trimethylammoniumethyl methacrylate chloride and the 2-hydroxyethyl methacrylate, were passed thru a Dehibit 100 column (Polysciences, Inc.) just prior to polymerization to remove the MeHQ polymerization inhibitor. The mixture was sparged with Argon for 1 hour and then 0.10 gram of AIBN polymerization initiator was added. The solution was refluxed (64° C.) for 19 hours. After cooling to ambient temperature under a gentle Argon flow, the polymer solution was coagulated into 2.7 liters of THF and the powdery solid was filtered and dried about 17 hours in vacuo (0.3 millimeter Hg) at 55° to 60° C. to provide 21.34. grams (63 percent) of the product, poly(2-hydroxyethyl methacrylate-co-N,N,N-trimethylammonium-N-2-ethyl methacrylate chloride). $^1$H-NMR analysis ($D_2O$) indicated about a 50 to 50 mole percent-repeat unit composition. This NMR result illustrates that the NMR signals indicated that the product contained about an equal number of polymeric repeat units (mole percent repeat units) derived from each of the two monomers charged.

CHARGE ADJUVANT PREPARATION 4

Poly(N,N-dimethyl-3,5-dimethylenepiperidinium chloride) or Poly(diallyl-N,N-dimethylammonium chloride)

About 21 grams of the title polymer as a 20 weight percent water solution (Scientific Polymer Products #175; $M_w$ 200,000 to 300,000) was rotoevaporated (for 1 hour at 70° to 80° C. at 40 to 50 millimeters Hg) to dryness. To 4.15 grams of the above isolated polymer were added 40 to 50 grams of methanol and the somewhat hazy solution was precipitated into 1 liter of magnetically agitated THF. The precipitated colorless solid was vacuum filtered and dried for 3 hours in vacuo at 40° to 45° C. A quantitative recovery of a powdery solid poly(N,N-dimethyl-3,5-dimethylenepiperidinium chloride) was obtained and stored in a desiccator until incorporation into a toner.

CHARGE DIRECTOR SYNTHESIS I

Synthesis of Hydroxy Bis[3,5-Tertiary Butyl Salicylic]Aluminate Monohydrate at Elevated Temperature To a solution of 12 grams (0.3 mole) of NaOH in 500 milliliters of water were added 50 grams (0.2 mole) of di-tert-butyl salicylic acid. The resulting mixture was heated to 60° C. to dissolve the acid. A second solution was prepared from dissolving 33.37 grams (0.05 mole) of aluminum sulfate, $Al_2(SO_4)_3$-$18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis[3,5-tertiary butyl salicylic]aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis[3,5-tertiary butyl salicylic]aluminate monohydrate was analyzed for water of hydration by Karl-Fischer titration after drying for an additional 24 hours at 100° C. in a vacuum, the sample contained 2.1 weight percent of water.

The theoretical value calculated for a monohydrate is 3.2 weight percent of water.

Infrared spectra of the above product hydroxy bis[3,5-tertiary butyl salicylic]aluminate monohydrate indicated the absence of peaks characteristic of the starting material di-tert-butyl salicylic acid and indicated the presence of a Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above: prepared monohydrate.

Elemental Analysis Calculated for $C_{30}H_{41}O_7Al$: C, 66.25; H, 7.62; Al, 5.52. Calculated for $C_{30}H_{41}O_7Al.1H_2O$: C, 64.13; H, 7.74; Al, 4.81. Found: C, 64.26; H, 8.11; Al, 4.67.

CHARGE DIRECTOR SYNTHESIS II

Synthesis of Hydroxy Bis[3,5-Tertiary Butyl Salicylic]Aluminate Hydrate at Room Temperature and Developer The procedure of Charge Director Synthesis I was repeated with the exception that the mixing of the two solutions and subsequent stirring was accomplished at room temperature, about 25° C. The product was isolated and dried as in Charge Director Synthesis I, and identified as the above hydroxy aluminum complex hydrate by IR.

Control 1:

Toner Containing No Charge Adjuvant: 181.8 Grams of NUCREL 599® (a copolymer of ethylene and methacrylic acid with a melt index at 190° (; of 500 available from E. I. DuPont de Nemours & Company, Wilmington, Del.), 45.4 grams of the cyan pigment (PV FAST BLUE™), and 307.4 grams of NORPAR 15™ (Exxon Corporation) were added to a Union Process 15 attritor (Union Process Company, Akron, Ohio) charged with 0.1875 inch (4.76 millimeters) diameter carbon steel balls. The mixture was milled in the attritor which was heated with running steam through the attritor jacket at 85° to 95° C. for 2 hours and cooled by running water through the attritor jacket to 14° C. with an additional 980.1 grams of NORPAR 15™ added and ground in the attritor for an additional 4.0 hours. An additional 1,540 grams of NORPAR 15™ were added and the mixture was separated from the steel balls yielding a developer concentrate of 7.29 percent solids (theory 7.5 percent). Small, for example about 2 percent, mechanical losses of toner solids were encountered during isolation of the toner concentrate. This toner concentrate was diluted to a developer containing 1 percent toner solids with more NORPAR 15™ to produce a 1,500 gram sample of developer wherein the solid components (1 percent of total developer) were toner resin (80 weight percent) and cyan pigment (20 weight percent). No charge adjuvant was incorporated into this formulation. To this developer was added 0.22 gram of hydroxy bis[3,5-tertiary butyl salicyclic] aluminate monohydrate charge director as prepared in Charge Director Synthesis I. The charge director level in this toner dispersion was 15 milligrams per gram of toner solids. The charging characteristics and image quality obtained on a Savin 870 copier were measured after about 17 days and are reported in the following Table 1.

EXAMPLE I

Toner Containing 5 Percent of Charge Adjuvant 1B: Poly(styrene-co-N,N,N-trimethylammonium-N-2-ethyl methacrylate tosylate)+15 Milligrams of Charge Director per Gram of Toner Solids 170.4 Grams of NUCREL 599® (a copolymer of ethylene and methacrylic acid with a melt index at 190° C. of 500 available from E. I. DuPont de Nemours & Company, Wilmington, Del.), 45.4 grams of the cyan pigment (PV FAST BLUE™), 11.4 grams of poly(styrene-co-N,N,N-trimethylammonium-N- 2-ethyl methacrylate tosylate) as prepared in Charge Adjuvant Synthesis 1B, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 82° to 96° C. for 2 hours and cooled by running water through the attritor jacket to 14° C. with an additional 980.1 grams of NORPAR 15™ added and ground in the attritor for an additional 4.5 hours. An additional 1,524 grams of NORPAR 15™ were added and the mixture was separated from the steel balls yielding a toner concentrate of 7.3 percent solids wherein the solids were comprised of 75 weight percent of NUCREL 599™ toner resin, 20 weight percent of cyan pigment, and 5 weight percent of poly(styrene-co-N,N,N-trimethylammonium-N- 2-ethyl methacrylate tosylate) charge adjuvant 1B. This toner concentrate was diluted to 1 percent solids with more NORPAR 15™ to yield a 1,500 gram sample. To this was added 0.22 gram of hydroxy bis[3,5-tertiary butyl salicylic]aluminate monohydrate charge director as prepared in Charge Director Synthesis I. The charge director level in this toner dispersion was 15 milligrams per gram of toner solids. The charging characteristics and image quality obtained on a Savin 870 imaging apparatus, or copier were measured after 17 days and are reported in the following Table 1.

TABLE 1

| EXAMPLE | ESA Mobility E-10 $m^2/Vs$ | Cond. ps/cm | Savin 870 Image Quality |
|---|---|---|---|
| Control 1 No charge adjuvant | 1.27 | 19 | Low density prints at low development bias due to low mobility. |
| Example I (5%) Charge Adjuvant = Poly(styrene-co-N,N,N-trimethyl-ammonium-N-2-ethyl methacrylate tosylate)-1B | 1.71 | 15 | Adequate density prints at low development bias due to good mobility. |

CONTROL 1A

Toner With No Charge Adjuvant

The procedure of Control 1 was employed up to dilution of the toner concentrate. The toner concentrate of Control 1 was diluted with NORPAR 15™ and charge director solution to yield a 200 gram developer 1A containing 1 percent toner solids. To 27.43 grams of the toner concentrate of Control 1A were added 168.57 grams of NORPAR 15™ and 4.0 grams of a 2 weight percent NORPAR 15™ solution of hydroxy bis[3,5-tertiary butyl salicyclic]aluminate monohydrate charge director as prepared in Charge Director Synthesis I. This charge director level was 40 milligrams per gram of toner solids. The solid components of this developer (1 percent of total developer) were toner resin (80 weight percent) and cyan pigment (20 weight percent). No charge adjuvant was incorporated into this formulation. The charging characteristics were measured after 1 day and are reported in the following Table 1A.

EXAMPLE IA

Toner Containing 5 Percent of Charge Adjuvant 1B: Poly(styrene-co-N,N,N-trimethylammonium-N-2-ethyl methacrylate tosylate)+40 Milligrams of Charge Director per Gram of Toner Solids 170.4 Grams of NUCREL 599® (a copolymer of ethylene and methacrylic acid with a melt index at 190° C. of 500 and available from E. I. DuPont de Nemours & Company, Wilmington, Del.), 45.4 grams of the cyan pigment (PV FAST BLUE™), 11.4 grams of poly(styrene-co-N,N,N-trimethylammonium-N- 2-ethyl methacrylate tosylate) as prepared in Charge Adjuvant Synthesis 1B, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 85 to 95° C. for 2 hours and cooled by running water through the attritor jacket to 14° C. with an additional 980.1 grams of NORPAR™ 15 added and ground in the attritor for an additional 4.5 hours. An additional 1,531.2 grams of NORPAR 15™ were added and the mixture was separated from the steel balls yielding a toner concentrate of 7.27 percent solids wherein the solids were comprised of 75 weight percent of NUCREL 599® toner resin, 20 weight percent of cyan pigment, and 5 weight percent of poly(styrene-co-N,N,N-trimethylammonium-N-2-ethyl methacrylate tosylate) charge adjuvant 1B. A portion of this toner concentrate was diluted with NORPAR 15™ and charge director solution to yield a 200 gram developer containing 1 percent toner solids. To 27.51 grams of this toner concentrate were added 168.49 grams of NORPAR 15™ and 4.0 grams of a 2 weight percent of NORPAR 15™ solution of hydroxy bis[3,5-tertiary butyl salicyclic]aluminate monohydrate charge director as prepared in Charge Director Synthesis I. This charge director level was 40 milligrams per gram of toner solids. The charging characteristics of this toner were measured after 1 day and are reported in the following Table 1A.

EXAMPLE IB

Toner Containing 7 Percent of Charge Adjuvant 1B: Poly(styrene-co-N,N,N-trimethylammonium-N-2-ethyl methacrylate tosylate)

165.9 Grams of NUCREL 599® (a copolymer of ethylene and methacrylic acid with a melt index at 190° C. of 500 and available from E. I. DuPont de Nemours & Company, Wilmington, Del.), 45.4 grams of the cyan pigment (PV FAST BLUE™), 15.9 grams of poly(styrene-co-N,N,N-trimethylammonium-N- 2-ethyl methacrylate tosylate) as prepared in Charge Adjuvant Synthesis 1B, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 85 to 95° C. for 2 hours and cooled by running water through the attritor jacket to 26° C. with an additional 980.1 grams of NORPAR 15™ added and ground in the attritor for an additional 4.5 hours. An additional 1,510 grams of NORPAR 15™ were added and the mixture was separated from the steel balls yielding a toner concentrate of 7.32 percent solids wherein the solids were comprised of 73 weight percent of NUCREL 599® toner resin, 20 weight percent of cyan pigment, and 7 weight percent of poly(styrene-co-N,N,N-trimethylammonium-N- 2-ethyl methacrylate tosylate) charge adjuvant 1B. A portion, about ½, of this toner concentrate were diluted with NORPAR 15™ and charge director solution to yield a 200 gram developer containing 1 percent toner solids. To 27.32 grams of this developer concentrate was added 168.68 grams of NORPAR 15™ and 4.0 grams of a 2 weight percent NORPAR 15™ solution of hydroxy bis[3,5-tertiary butyl salicyclic]aluminate monohydrate charge director as prepared in Charge Director Synthesis I. This charge director level was 40 milligrams per gram of toner solids. The charging characteristics of this toner were measured after 1 day and are reported in the following Table 1A.

EXAMPLE IC

Toner Containing 3 Percent of Charge Adjuvant 1B: Poly(styrene-co-N,N,N-trimethylammonium-N-2-ethyl methacrylate tosylate)

175.0 Grams of NUCREL 599® (a copolymer and of ethylene and methacrylic acid with a melt index at 190° C. of 500 available from E. I. DuPont de Nemours & Company, Wilmington, Del.), 45.4 grams of the cyan pigment (PV FAST BLUE™), 6.8 grams of poly(styrene-co-N,N,N-trimethylammonium-N- 2-ethyl methacrylate tosylate) as prepared in Charge Adjuvant Synthesis 1B, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 85 to 95° C. for 2 hours and cooled by running water through the attritor jacket to 25° C. with an additional 980.1 grams of NORPAR 15™ added and ground in the attritor for an additional 4.67 hours. An additional 1,492 grams of NORPAR 15™ were added and the mixture was separated from the steel balls yielding a toner concentrate of 7.29 percent solids wherein the solids were comprised of 77 weight percent of NUCREL 599® toner resin, 20 weight percent of cyan pigment, and 3 weight percent of poly(styrene-co-N,N,N-trimethylammonium-N- 2-ethyl methacrylate tosylate) charge adjuvant 1B. A portion, about ½, of this toner concentrate was diluted with NORPAR 15™ and charge director solution to provide a 200 gram developer containing 1 percent of toner solids. To 27.43 grams of this toner concentrate were added 168.57 grams of NORPAR 15™ and 4.0 grams of a 2 weight percent NORPAR 15™ solution of hydroxy bis[3,5-tertiary butyl salicyclic]aluminate monohydrate charge director as prepared in Charge Director Synthesis I. This charge director level was 40 milligrams per gram of toner solids. The charging characteristics of this toner were measured after 1 day and are reported in the following Table 1A.

EXAMPLE ID

Toner Containing 5 Percent of Charge Adjuvant 1C: Poly(styrene-co-N,N,N-trimethylammonium-N-2-ethyl methacrylate bromide)

18.75 Grams of NUCREL 599® (a copolymer of ethylene and methacrylic acid with a melt index at 190° C. of 500 available from E. I. DuPont de Nemours & Company, Wilmington, Del.), 5.00 grams of the cyan pigment (PV FAST BLUE™), 1.25 grams of poly(styrene-co-N,N,N-trimethylammonium-N- 2-ethyl methacrylate tosylate) as prepared in Charge Adjuvant Synthesis 1C, and 142.0 grams of NORPAR 15™ (Exxon Corporation) were added to a Union Process 01 attritor (Union Process Company, Akron, Ohio) charged with 0.1875 inch (4.76 millimeters) diameter carbon steel balls. The resulting mixture was milled in the attritor which was heated with running steam through the attritor jacket at 98 to 54° C. for 2 hours and cooled by running water through the attritor jacket to 18° C. and ground in the attritor for an additional 4.67 hours. About 750 grams of NORPAR 15™ were added and the mixture was separated from the steel balls yielding a toner concentrate of 4.06 percent solids wherein the solids were comprised of 75 weight percent NUCREL 599® toner resin, 20 weight percent of cyan pigment, and 5 weight percent of poly(styrene-co-N,N,N-trimethylammonium-N- 2-ethyl methacrylate bromide) charge adjuvant 1C. A portion of this toner concentrate was diluted with NORPAR 15™ and charge director solution to yield a 200 gram developer containing 1 percent toner solids. To 49.26 grams of this toner (developer) concentrate were added 146.74 grams of NORPAR 15™ and 4.0 grams of a 2 weight percent NORPAR 15™ solution of hydroxy bis[3,5-tertiary butyl salicyclic]aluminate monohydrate charge director as prepared in Charge Director Synthesis I. The charge director level was 40 milligrams per gram of toner solids. The charging characteristics of this toner were measured after 1 day and are reported in the following Table 1A.

EXAMPLE IE

Toner Containing 5 Percent of Charge Adjuvant 1E: Poly[styrene-co-N-(2-ethoxyethyl)-N,N-dimethylammonium-N- 2-ethyl methacrylate bromide1

18.75 Grams of NUCREL 599® (a copolymer of ethylene and methacrylic acid with a melt index at 190° C. of 500 available from E. I. DuPont de Nemours & Company, Wilmington, Del.), 5.00 grams of the cyan pigment (PV FAST BLUE™), 1.25 grams of poly[styrene-co-N-(2-ethoxyethyl)-N,N-dimethylammonium-N- 2-ethyl methacrylate bromide] as prepared in Charge Adjuvant Synthesis 1E, and 142.0 grams of NORPAR 15™ (Exxon Corporation) were added to a Union Process 01 attritor (Union Process Company, Akron, Ohio) charged with 0.1875 inch (4.76 millimeters) diameter carbon steel balls. The resulting mixture was milled in the attritor which was heated with running steam through the attritor jacket at 100 to 55° C. for 2 hours and cooled by running water through the attritor jacket to 22° C. and ground in the attritor for an additional 4.0 hours. About 750 grams of NORPAR 15™ were added and the mixture was separated from the steel balls yielding a toner concentrate of 2.80 percent solids wherein the solids consisted of 75 weight percent of NUCREL 599® toner resin, 20 weight percent of cyan pigment, and 5 weight percent of poly[styrene-co-N-( 2-ethoxyethyl)-N,N-dimethylammonium-N-2-ethyl methacrylate bromide] charge adjuvant 1E. A portion of this toner concentrate was diluted with NORPAR 15™ and charge director solution to yield a 200 gram developer containing 1 percent toner solids. To 27.51 grams of this developer concentrate were added 168.49 grams of NORPAR 15™ and 4.0 grams of a 2 weight percent of NORPAR 15™ solution of hydroxy bis[3,5-tertiary butyl salicyclic]aluminate monohydrate charge director as prepared in Charge Director Synthesis I. This charge director level was 40 milligrams per gram of toner solids. The charging characteristics of this toner were measured after 1 day and are reported in the following Table 1A.

TABLE 1A

| EXAMPLE | ESA Mobility E-10 $m^2/Vs$ | Cond. ps/cm | Comments |
|---|---|---|---|
| Control 1A No Charge Adjuvant Example | 2.57 | 7 | Good Mobility and Low Conductivity |
| IC (3%) | 3.58 | 6 | Excellent |
| IA (5%) | 3.44 | 6 | Mobility and |
| IB (7%) | 3.66 | 6 | Lower Conductivity |
| Charge Adjuvant = Poly(styrene-co-N,N,N-trimethyl-ammonium-N-2-ethyl methacrylate tosylate)-1B | | | |
| Example ID (5%) Charge Adjuvant = Poly(styrene-co-N,N,N-trimethyl-ammonium-N-2-ethyl methacrylate bromide)-1C | 3.22 | 5 | Excellent Mobility and Still Lower Conductivity |
| Example IE (5%) Charge Adjuvant = Poly[styrene-co-N-(2-ethoxyethyl)-N,N-dimethylammonium-N-2-ethyl methacrylate bromide]-1E | 3.38 | 5 | Excellent Mobility and Still Lower Conductivity |

CONTROL 2

To a 1,500 gram 1 percent solids dispersion of Control 1 liquid toner wherein the solids were comprised of 80 weight percent of NUCREL 599® toner resin and 20 weight percent of cyan pigment were added 2.25 grams of EMPHOS D70-30C™ charge director. The charge director level in this toner dispersion was 150 milligrams per gram of toner solids. The charging characteristics and image quality obtained on a Savin 870 copier were measured after about 17 days and are reported in the following Table 2.

EXAMPLE II

To a 1,500 gram 1 percent solids dispersion of Example I liquid toner wherein the solids comprise 75 weight percent of NUCREL 599® toner resin, 20 weight percent of cyan pigment, and 5 weight percent of Poly(styrene-co-N,N,N-trimethylammonium-N-2-ethyl methacrylate tosylate) charge adjuvant were added 2.25 grams of EMPHOS D70-30C™ charge director. The charge director level in this toner dispersion was 150 milligrams per gram of toner solids. The charging characteristics and image quality for this positively charged developer obtained on a Savin 870 copier were measured after about 17 days and are reported in the following Table 2.

TABLE 2

| EXAMPLE | ESA Mobility E-10 $m^2/Vs$ | Cond. ps/cm | Savin 870 Image Quality | Comments |
|---|---|---|---|---|
| Control 1 No Charge Adjuvant | 0.74 | 5 | Poor Resolution, Hollow Characters, Image Breakup | Fair Mobility Poor Image Quality |
| Example II Charge Adjuvant = Poly(styrene-co-N,N,N-trimethylammonium-N-2-ethyl methacrylate tosylate)-1B | 0.61 | 5 | Good Resolution, Solid Characters and Intact Image. Minimum Background Imaging. | Fair Mobility With Image Quality Better Than Control |

EXAMPLE III 18.75 Grams of NUCREL 599® (a copolymer of ethylene and methacrylic acid with a melt index at 190° C. of 500 available from E. I. DuPont de Nemours & Company, Wilmington, Del.), 5.0 grams of the cyan pigment (PV FAST BLUE™), 1.25 grams of poly(4-vinylpyridine-co-4-vinyl-N-methylpyridinium bromide) (repeat unit molar ratio of 20:80) as obtained in Charge Adjuvant Synthesis 2, and 142 grams of NORPAR 15™ (Exxon Corporation) were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket at 90° to 97° C. for 2 hours and cooled by running water through the attritor jacket to 14° C. and ground in the attritor for an additional 4.5 hours. Additional NORPAR 15™ was added and the mixture was separated from the steel balls. The solids in this developer concentrate were comprised of 75 percent of NUCREL 599®, 20 percent of cyan pigment and 5 percent of poly(4-vinylpyridine-co-4-vinyl-N-methylpyridinium bromide) charge adjuvant. This developer concentrate was diluted to 1 percent solids with more NORPAR 15™ to produce a 200 gram sample. To this 1 percent solids developer was added 0.030 gram of hydroxy bis[3,5-tertiary butyl salicylic]aluminate monohydrate charge director as prepared in Charge Director Synthesis I. The charge director level in this toner dispersion was 15 milligrams per gram of toner solids. The charging characteristics were measured after 2 days and are reported in the following Table 3.

EXAMPLE IV 18.75 Grams of NUCREL 599® (a copolymer of ethylene and methacrylic acid with a melt index at 190° C. of 500 available from E. I. DuPont de Nemours & Company, Wilmington, Del.), 5.0 grams of the cyan pigment (PV FAST BLUE™), 1.25 grams of poly(2-hydroxyethyl methacrylate-co-N,N,N-trimethylammonium-N-2-ethyl methacrylate chloride) (repeat unit molar ratio of about 50:50) as prepared in Charge Adjuvant Synthesis 3, and 142 grams of NORPAR 15™ (Exxon Corporation) were added to a Union Process 0 1 attritor (Union Process Company, Akron, Ohio) charged with 0.1875 inch (4.76 millimeters) diameter carbon steel balls. The mixture was milled in the attritor which was heated with running steam through the attritor jacket at 90° to 97° C. for 2 hours and cooled by running water through the attritor jacket to 14° C. and ground in the attritor for an additional 4.5 hours. Additional NORPAR 15™ was added and the mixture was separated from the steel balls. The solids in the developer concentrate were comprised of 75 percent of NUCREL 599® developer resin, 20 percent of cyan pigment, and 5 percent of poly(2-hydroxyethyl methacrylate-co-N,N,N-trimethylammonium-N-2-ethyl methacrylate chloride) (repeat unit molar ratio of about 50:50) charge adjuvant. This developer concentrate was diluted to 1 percent solids with more NORPAR 15™ to produce a 200 gram sample. To this 1 percent solids developer was added 0.030 gram of hydroxy bis[3,5-tertiary butyl salicylic]aluminate monohydrate charge director as prepared in Charge Director Synthesis I. The charge director level in this toner dispersion was 15 milligrams per gram of toner solids. The charging characteristics were measured after 2 days and are reported in the following Table 3.

TABLE 3

| EXAMPLE | ESA Mobility E-10 $m^2/Vs$ | Conductivity ps/cm | Comments |
|---|---|---|---|
| Control 1 No Charge Adjuvant | 1.27 | 19 | Fair Mobility Due to Low Particle Charge |
| Example III (5%) Charge Adjuvant = Poly(4-vinylpyridine-co-4-vinyl-N-methylpyridinium bromide)-2 | 2.10 | 7 | Excellent Mobility Due to Very High Particle Charge |
| Example IV (5%) Charge Adjuvant = Poly(2-hydroxyethyl methacrylate-co-N,N,N-trimethyl-ammonium-N-2-ethyl methacrylate chloride)-3 | 1.71 | 9 | Good Mobility Due to High Particle Charge |

CONTROL 2A 25.6 Grams of*NUCREL 599® (a copolymer of ethylene and methacrylic acid with a melt index at 190° C. of 500 available from E. I. DuPont de Nemours & Company, Wilmington, Del.), 6.4 grams of the cyan pigment (PV FAST BLUE™), and 170 grams of NORPAR 15™ (Exxon Corporation) were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket at about 100° C. for 2 hours and cooled by running water through the attritor jacket ambient temperature and ground in the attritor for an additional 4.5 hours. Additional NORPAR 15™ was added and the mixture was separated from the steel balls. The solids in this developer concentrate were comprised of 80 percent of NUCREL 599® developer resin and 20 percent of cyan pigment which were diluted to 1 percent solids with more NORPAR 15™ to produce a 200 gram sample. No charge adjuvant was incorporated into this developer formulation. To this 200 gram sample of 1 percent solids was added 0.22 gram of EMPHOS D70-30C™ charge director. The charge director level in this toner dispersion was 110 milligrams per gram of toner solids. The charging characteristics were measured after 11 days and are reported in the following Table 4.

CONTROL 3

24.6 Grams of NUCREL 599® (a copolymer of ethylene and methacrylic acid with a melt index at 190° C. of 500 available from E. I. DuPont de Nemours & Company, Wilmington, Del.), 6.4 grams of the cyan pigment (PV FAST BLUE™), 0.96 gram of N-cetylpyridinium chloride, and 170 grams of NORPAR 15™ (Exxon Corporation) were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket at about 100° C. for 2 hours and cooled by running water through the attritor jacket ambient temperature and ground in the attritor for an additional 4.5 hours. Additional NORPAR 15™ was added and the mixture was separated from the steel balls. The solids in the resulting developer concentrate were comprised of 77 percent of NUCREL 599® toner resin, 20 percent of cyan pigment, and 3 percent of N-cetylpyridinium chloride charge adjuvant. The resulting developer was diluted to 1 percent solids with more NORPAR 15™ to produce a 200 gram sample. To this 200 gram sample was added 0.22 gram of EMPHOS D70-30C™ charge director. The charge director level in this toner dispersion is 110 milligrams per gram of toner solids. The charging characteristics were measured after 11 days and are reported in the following Table 4.

EXAMPLE V 24.6 Grams of NUCREL 599® (a copolymer of ethylene and methacrylic acid with a melt index at 190° C. of 500 available from E. I. DuPont de Nemours & Company, Wilmington, Del.), 6.4 grams of the cyan pigment (PV FAST BLUE™), 0.96 gram of poly(N,N-dimethyl-3,5-dimethylene piperidinium chloride) as prepared in Charge Adjuvant Preparation 4, and 170 grams of NORPAR 15™ (Exxon Corporation) were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket at about 100° C. for 2 hours and cooled by running water through the attritor jacket ambient temperature and ground in the attritor for an additional 4.5 hours. Additional NORPAR 15™ was added and the mixture was separated from the steel balls. The solids in this toner concentrate consist of 77 percent of NUCREL 599® toner resin, 20 percent of cyan pigment, and 3 percent of poly(N,N-dimethyl-3,5-dimethylene piperidinium chloride) charge adjuvant. This toner concentrate was diluted to 1 percent solids with NORPAR 15™ to produce a 200 gram sample. To this 200 gram sample was added 0.22 gram of EMPHOS D70-30C™ charge director. The charge director level in this toner dispersion was 110 milligrams per gram of toner solids. The charging characteristics were measured after 11 days and are reported in the following Table 4.

TABLE 4

| EXAMPLE | ESA Mobility E-10 $m^2/Vs$ | Conductivity ps/cm | Comments |
|---|---|---|---|
| Control 2A No Charge Adjuvant | 0.354 | 8 | Poor Mobility Due to Very Low Particle Charge |
| Control 3 (3%) Charge Adjuvant = N-cetylpyridinium Chloride | 0.13 | 1 | Very Poor Mobility Due to Very Low Particle Charge |
| Example V (3%) Charge adjuvant = Poly(N,N-dimethyl-3,5-dimethylene piperidinium chloride) | 0.79 | 4 | Fair Mobility Due to Larger Particle Charge Relative to Controls |

Mobility values in units of E-10 $m^2/Vs$ of less than 0.2 are considered to be very poor, values between 0.2 and 0.5 are considered to be poor, values between 0.5 and 1.30 are considered to be fair, values between 1.30 and 1.80 are considered to be good, and values larger than 1.80 are considered to be excellent. The unit of mobility has a "$m^2$" term which means meters squared.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A positively charged liquid developer consisting essentially of a nonpolar liquid, thermoplastic resin particles, pigment, a charge director, and an insoluble charge adjuvant comprised of a polymeric quaternary ammonium compound.

2. A developer in accordance with claim 1 wherein the polymeric quaternary ammonium compound is a poly(styrene-co-N,N,N-trimethylammonium-N- 2-ethyl methacrylate tosylate).

3. A developer in accordance with claim 1 wherein the polymeric quaternary ammonium compound is a poly(4-vinylpyridine-co-4-vinyl-N-methylpyridinium bromide).

4. A developer in accordance with claim 1 wherein the polymeric quaternary ammonium compound is poly(2-hydroxyethyl methacrylate-co-N,N,N-trimethylammonium-N-2-ethyl methacrylate chloride).

5. A developer in accordance with claim 1 wherein the polymeric quaternary ammonium compound is a poly(N,N-dimethyl-3,5-dimethylenepiperidinium chloride.

6. A developer in accordance with claim 1 wherein the polymeric quaternary ammonium compound is a poly(styrene-co-N,N,N-trimethylammonium-N- 2-ethyl methacrylate halide).

7. A developer in accordance with claim 1 wherein said nonpolar liquid is hydrocarbon component.

8. A positively charged liquid electrostatographic developer comprised of (A) a liquid with a viscosity of from about 0.5 to about 20 centipoise and resistivity greater than or equal to about $5\times10^9$; (B) thermoplastic resin particles with an average volume particle diameter of from about 0.1 to about 30 microns and optional pigment; (C) a polymeric quaternary ammonium charge adjuvant; and (D) a charge director.

9. A developer in accordance with claim 8 wherein the resin particles are comprised of a copolymer of ethylene and an α-β-ethylenically unsaturated acid selected from the group consisting of acrylic acid and methacrylic acid; a copolymer of ethylene acrylic or methacrylic acid, alkylester of acrylic or methacrylic acid; or a copolymer of ethylene and methacrylic acid with a melt index at 190° C. of 500.

10. A developer in accordance with claim 1 wherein the resin particles are comprised of a copolymer of ethylene and an α-β-ethylenically unsaturated acid selected from the group consisting of acrylic acid and methacrylic acid; a copolymer of ethylene acrylic or methacrylic acid, alkylester of acrylic or methacrylic acid; or a copolymer of ethylene and methacrylic acid with a melt index at 190° C. of 500.

11. A developer in accordance with claim 1 wherein the pigment is present in an amount of about 0.1 to 60 percent by weight based on the total weight of the developer solids of resin, charge adjuvant and pigment.

12. A developer in accordance with claim 1 containing a dye.

13. A developer in accordance with claim 1 wherein the pigment is black, cyan, magenta, yellow, or mixtures thereof.

14. A developer in accordance with claim 1 wherein the pigment is carbon black.

15. A developer in accordance with claim 1 wherein the charge adjuvant is present in an amount of from about 0.1 to about 10 weight percent based on the weight of the developer solids.

16. A developer in accordance with claim 8 wherein component (A) is present in an amount of from about 85 percent to about 99.9 percent by weight, based on the total weight of the liquid developer components, the total weight of developer solids is from about 0.1 percent to about 15 percent by weight, and component (D) is present in an amount of from about 5 to about 1,000 milligrams/gram developer solids.

17. A developer in accordance with claim 8 wherein component (C) is present in an amount of from about 0.1 to about 20 percent by weight of developer solids.

18. A developer in accordance with claim 8 further containing a second charge adjuvant selected from the group consisting of paratoluene sulfonic acid and polyphosphoric acid.

19. A developer in accordance with claim 7 wherein said hydrocarbon component is an aliphatic hydrocarbon.

20. A developer in accordance with claim 19 wherein the aliphatic hydrocarbon is a mixture of branched hydrocarbons with from about 12 to about 20 carbons atoms, or wherein the aliphatic hydrocarbon is a mixture of normal hydrocarbons of from about 10 to about 20 carbon atoms.

21. A developer in accordance with claim 8 wherein component (D) is a metal soap.

22. A developer in accordance with claim 8 wherein component (D) is an aluminum soap, a sodium salt of phosphated mono- and diglycerides with saturated and unsaturated substituents, or an alkyl salicylic acid aluminum complex.

23. A developer in accordance with claim 8 wherein component (D) is a hydroxy bis[3,5-tertiary butyl salicyclic] aluminate monohydrate.

24. A developer in accordance with claim 1 wherein said resin particles, pigment, and charge adjuvant are dispersed in a mixture of charge director and a liquid hydrocarbon component.

25. An imaging method which comprises forming an electrostatic latent image followed by the development thereof with the liquid developer of claim 1.

26. A positively charged liquid developer consisting essentially of a nonpolar liquid, thermoplastic resin, pigment, a charge director, and an insoluble polymeric quaternary ammonium charge adjuvant compound.

27. A developer in accordance with claim 26 wherein the polymeric ammonium compound is selected from the group consisting of a poly(styrene-co-N,N,N-trimethylammonium-N-2-ethyl methacrylate tosylate), poly(4-vinylpyridine-co-4-vinyl-N-methylpyridinium bromide), poly(2-hydroxyethyl methacrylate-co-N,N,N-trimethylammonium-N-2-ethyl methacrylate chloride), poly(N,N-dimethyl-3,5-dimethylenepiperidinium chloride, and poly(styrene-co-N,N,N-trimethylammonium-N-2-ethyl methacrylate halide).

28. A positively charged liquid developer consisting of a nonpolar liquid, thermoplastic resin, pigment, a charge director, and an insoluble charge adjuvant, and wherein said adjuvant is a polymeric quaternary ammonium compound selected from the group consisting of poly(styrene-co-N,N,N-trimethylammonium-N-2-ethyl methacrylate tosylate), poly(4-vinylpyridine-co-4-vinyl-N-methylpyridinium bromide), poly(2-hydroxyethyl methacrylate-co-N,N,N-trimethylammonium-N-2-ethyl methacrylate chloride), poly(N,N-dimethyl-3,5-dimethylenepiperidinium chloride, and poly(styrene-co-N,N,N-trimethylammonium-N-2-ethyl methacrylate halide).

* * * * *